US005987819A

United States Patent [19]

Smith

[11] Patent Number: 5,987,819

[45] Date of Patent: Nov. 23, 1999

[54] WINDOW REGULATOR HAVING IMPROVED CRANK ASSEMBLY

[75] Inventor: Peter J. Smith, Newmarket, Canada

[73] Assignee: Atoma International Inc., Newmarket, Canada

[21] Appl. No.: 09/073,356

[22] Filed: May 6, 1998

Related U.S. Application Data

[60] Provisional application No. 60/045,699, May 6, 1997.

[51] Int. Cl.[6] ..... E05F 11/48

[52] U.S. Cl. ..... 49/352; 49/348

[58] Field of Search ..... 49/352; 192/223.2, 192/45; 464/35, 160

[56] References Cited

U.S. PATENT DOCUMENTS

| | | | |
|---|---|---|---|
| 1,997,646 | 4/1935 | Miller . | |
| 2,559,960 | 7/1951 | Houplain . | |
| 2,583,428 | 1/1952 | Houplain | 192/223.2 |
| 3,243,023 | 3/1966 | Boyden . | |
| 3,440,892 | 4/1969 | Eskra | 74/89.18 |
| 3,576,240 | 4/1971 | Nicholson . | |
| 4,658,546 | 4/1987 | Moriyama | 49/352 |
| 4,944,375 | 7/1990 | Ohta et al. . | |
| 5,086,586 | 2/1992 | Hlavaty et al. | 49/351 X |

FOREIGN PATENT DOCUMENTS

| | | | |
|---|---|---|---|
| 0 301 645 A1 | 2/1989 | European Pat. Off. | E05F 11/50 |
| 633 274 | 1/1928 | France . | |
| 3442308 A1 | 5/1986 | Germany | E05F 15/00 |

OTHER PUBLICATIONS

International Search Report re: PCT/CA98/00420 dated Sep. 24, 1998.

*Primary Examiner*—Daniel P. Stodola
*Assistant Examiner*—Hugh B. Thompson
*Attorney, Agent, or Firm*—Pillsbury Madison & Sutro LLP

[57] ABSTRACT

A window regulator assembly comprising a window panel, a track, a slider member, a slider moving assembly including a drive assembly and a coupling assembly. The track is constructed and arranged to guide the window panel during movement of the window panel between opened and closed positions. The slider member is constructed and arranged to be movable along the track between a first position wherein the window panel assumes the closed position and a second position wherein the window panel assumes the open position. The slider moving assembly is constructed and arranged to move the slider member between the first and second position. The coupling assembly of the slider moving assembly is constructed and arranged to couple an output movement of the drive assembly to the slider member. The drive assembly includes a drivable input structure and a driven output structure, which structures are rotatable about a common axis. The coupling assembly is connected with the output structure to receive the output of the output structure, thereby enabling the coupling assembly to couple the output movement of the drive assembly to the slider member. The drive assembly includes roller and spring members disposed within a housing and constructed and arranged to prevent movement of the output structure upon predetermined external force being applied thereto via the coupling assembly. The output structure has ramp surfaces each converging toward the housing. Each of the ramp surfaces frictionally engages an associated one of the rollers, the rollers being biased by the spring members in a converging surface direction towards the converging surfaces between the ramp surfaces and the housing. The rollers are thus biased into wedging relation between the ramp surfaces and the housing. Friction between the ramp surfaces and the associated rollers during application of the predetermined external force to the output structure urges rolling movement of the rollers in the converging surface direction and into further wedging relation between the ramp surfaces and the housing.

8 Claims, 4 Drawing Sheets

WINDOW REGULATOR HAVING IMPROVED CRANK ASSEMBLY

This application claims the benefit of U.S. Provisional Application No. 60/045,699, filed May 6, 1997.

BACKGROUND OF THE INVENTION

The present invention relates to a window regulator having an improved crank assembly for a motor vehicle window. The crank assembly uses a roller-ramp principle to lock the crank assembly against backdrive displacement when the window is directly engaged and has a downward force applied thereto. This assembly is relatively inexpensive and more effective than previous designs. It also reduces free play of the window and between the drive and driven members in the device.

It has been well established for automobile window regulators to employ a spring clutch type mechanism for coupling the window crank handle to the vehicle window. An example of this type of arrangement is illustrated in U.S. Pat. No. 1,997,646. While these arrangements have been effective, they permit an undesirable amount of displacement or free play upon manual engagement and backdriven movement of the window itself towards a raised or lowered direction. Such backdriven movement may even manifest itself as slight movement in the input crank handle. It is an object of the present invention to reduce or substantially eliminate such backdriven movement. It is also an object of the present invention to reduce the number of parts required and provide a more cost-effective assembly.

In accordance with the objects of the present invention, there is provided a window regulator assembly comprising a window panel, a track, a slider member, a slider moving assembly including a drive assembly and a coupling assembly. The track is constructed and arranged to guide the window panel during movement of the window panel between opened and closed positions. The slider member is constructed and arranged to be movable along the track between a first position wherein the window panel assumes the closed position and a second position wherein the window panel assumes the open position. The slider moving assembly is constructed and arranged to move the slider member between the first and second position, The coupling assembly of the slider moving assembly is constructed and arranged to couple an output movement of the drive assembly to the slider member. The drive assembly includes a drivable input structure and a driven output structure, which structures are rotatable about a common axis. The coupling assembly is connected with the output structure to receive the output of the output structure, thereby enabling the coupling assembly to couple the output movement of the drive assembly to the slider member. The drivable input structure is constructed and arranged to receive an external driving force so as to be rotated about its axis. The driven output structure is driven for rotational movement about its axis by rotation of the input structure. The drive assembly includes roller and spring members disposed within a housing and constructed and arranged to prevent movement of the output structure upon predetermined external force being applied thereto via the coupling assembly. The output structure has ramp surfaces each converging toward the housing. Each of the ramp surfaces frictionally engages an associated one of the rollers, the rollers being biased by the spring members in a converging surface direction towards the converging surfaces between the ramp surfaces and the housing. The rollers are thus biased into wedging relation between the ramp surfaces and the housing. Friction between the ramp surfaces and the associated rollers during application of the predetermined external force to the output structure urges rolling movement of the rollers in the converging surface direction and into further wedging relation between the ramp surfaces and the housing. The wedging relation of the rollers between the ramp surfaces and the housing prevents movement of the output structure upon application of the predetermined external force being applied thereto. The input structure is rotatable to engage the rollers upon application of the external driving force and thereby move the rollers against the bias of the spring members and away from the converging surface direction, the rollers thus being moved out of the wedging relation between the ramp surfaces and the housing so that continued driven movement of the input structure after engagement thereof with the rollers is received by the output structure so that the output structure is thereby driven to move the slider member and thus the window panel via the coupling assembly.

Other objects and advantages of the present invention will be apparent from the following detailed description, drawings, and claims.

DETAILED DESCRIPTION OF THE PREFERRED EMBODIMENTS

Figure 1:
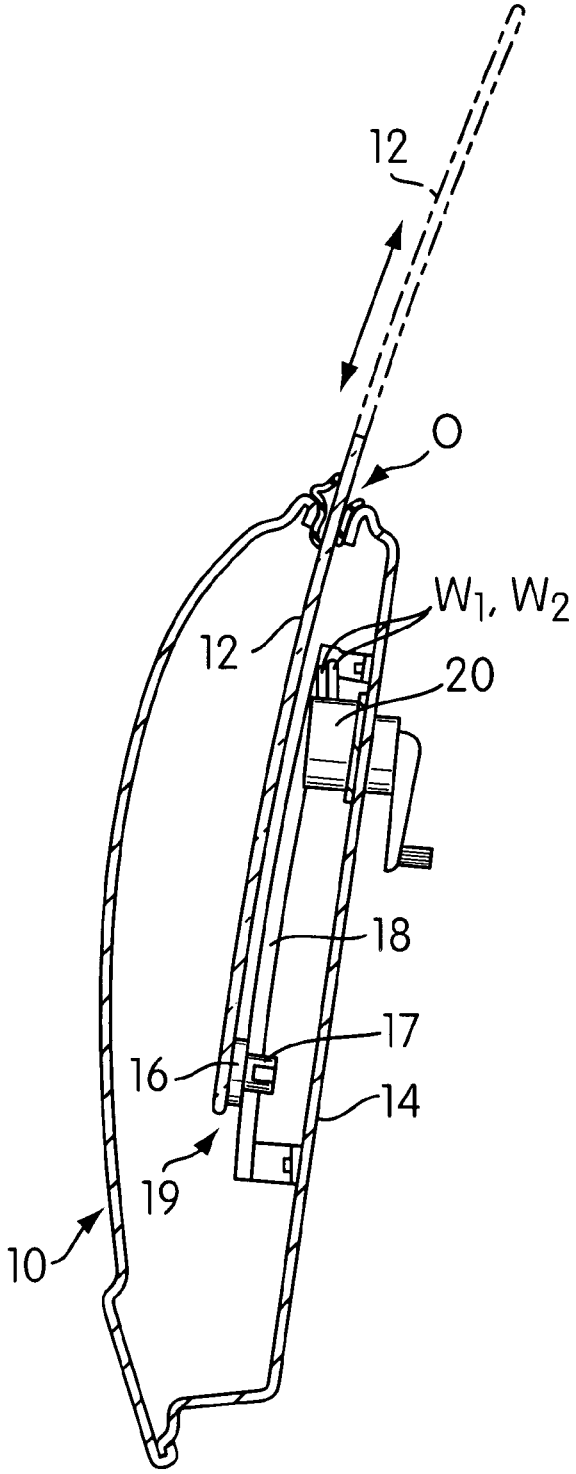
FIG. 1 is a sectional view of a drum and cable type window regulator assembly incorporating the crank assembly of the present invention, and shown incorporated in an automotive vehicle door structure.

In FIG. 1, the window regulator assembly or mechanism is shown as incorporated in an automotive vehicle door structure 10 for operating a vertically movable window panel 12. The door structure comprises an inner panel 14 formed at its lower portion with a terminal flange over which the marginal portion of an outer panel is crimped to provide an integral structure having a space or well between the inner and outer panels. The window well has a slot or access opening through which the window panel 12 is slidably disposed into and out of the well by the window regulator mechanism positioned within the window well at the inner side of the path of travel of the window panel 12. The window regulator mechanism includes a lifter plate 16 secured on the lower potion of the window panel 12. A slider member 17 is secured to the lifter plate 16 and mounted for sliding movement along a longitudinal guide track or rail member 18 bolted on the inner panel 14. The slider member 17 and lifter plate 16 fixed thereto can together be considered a mounting assembly 19 which is fixed to the window panel and mounts the window panel for movement on the guide rail or track member 18. The mounting assembly 19 is movable along the rail member 18 between a first position wherein the window assumes a closed or raised position and a second position wherein the window assumes an opened or lowered position.

The track 18 is preferably steel or aluminum. A slider moving assembly 21 moves the slider member 17 between the first and second positions thereof. The slider moving assembly 21 includes drive assembly or unit 20 and a coupling assembly 23 which couples an output of the drive assembly 20 to the mounting assembly 19. The drive assembly includes a crank or clutch assembly 110 as will be described later, and a crank handle 40. In the present embodiment, the coupling assembly 23 includes a driven drum 30 connected with the drive assembly 20, and two wires W1 and W2 each connected at one end with the drum 30 and at an opposite end with the slider member 17 . The drive assembly 20 is mounted on the inner panel to aid in winding one of two wires W1 and W2 and retracting the other wire so as to move the lifter plate 16 up and down the guide rail or track 18.

Figure 2:
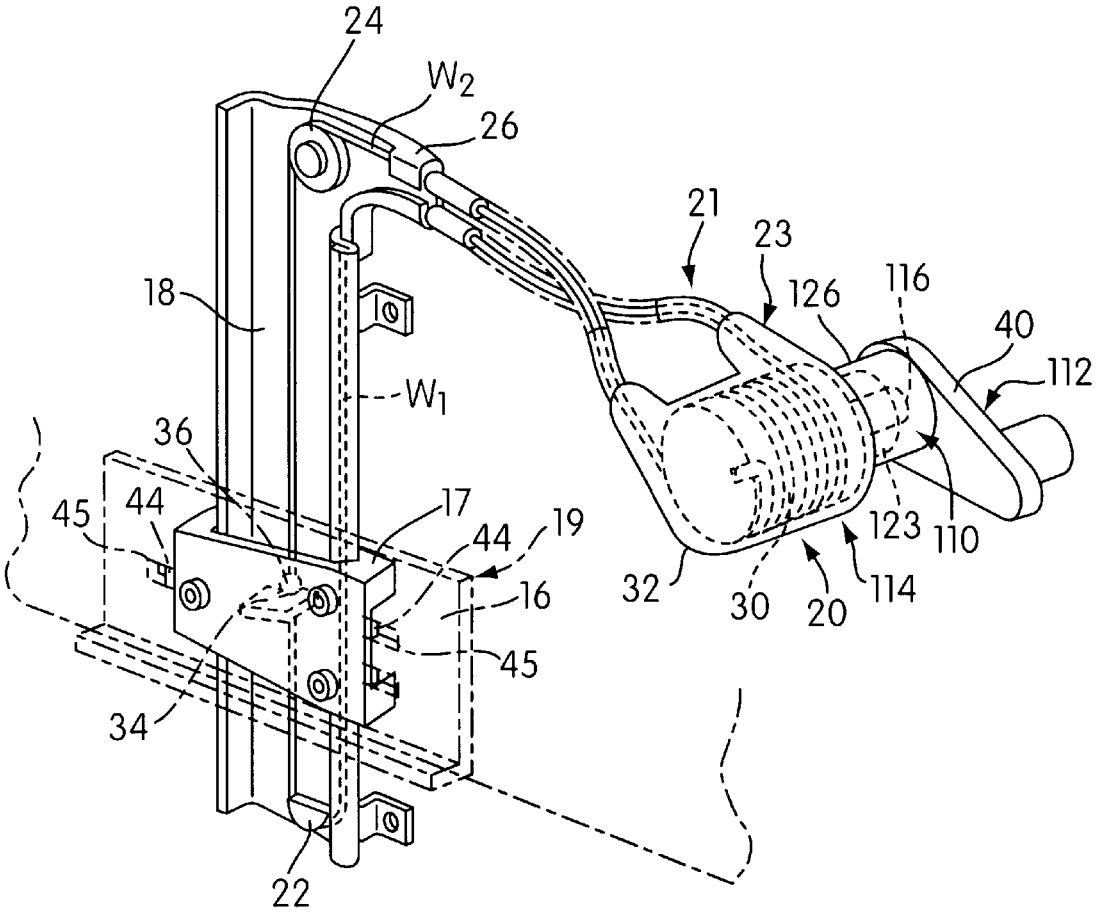
FIG. 2 is a schematic perspective view of the window regulator assembly and of FIG. 1, and particularly showing a lift plate slider assembly thereof.

Referring to FIG. 2, the guide rail 18 has at its lower end a semi-circular guide plate 22 secured thereon for guiding the wire W1 and at its upper end a guide pulley 24 secured rotatably thereon for guiding the wire W2. The guide plate 22 and pulley 24 constitute the limits of movement of the lifter plate 16. The guide rail 18 also has a guide opening 26 for guiding the wires W1 and W2 toward the drum 30 and drive assembly 20. As shown, the drum is 30 housed within a casing 32. The driven drum 30 forms part of the coupling assembly 23 for coupling the drive assembly 20 with the slider member 17. In particular, the drum 30 is mounted for rotation on output shaft 124 of the driven output structure 114 (see FIG. 3). The ends of wires W1 and W2 are attached to the drum 30 and are wound and unwound about the drum 30 during upward and downward movement of the window.

The slider member 17 has a nipple housing member 34 constructed and arranged to fixedly attach wire beads 36 fixed to the wire or cable W2. This enables the slider member to be slidably driven along rail 18 upon movement of wire W1, W2. The wire W1 extends downward from the nipple housing 34 to the semi-circular guide plate 22 around which it extends upward to the pulley 24 and through guide opening 26 and then through a guide tube to the driven drum 30. The wire W2 extends upward from the nipple housing 34 to the guide pulley 24 around which it extends to the guide opening 26 and then through a guide tube to the driven drum 30. The driven drum 30 rotates with rotation of the handle 40 in a manner to be described to effect movement of the wires W1 and W2 through the guide tubes. This in turn causes upwards or downwards movement of the slide member 17 along rail 18 depending on the direction the handle 40 is rotated.

Figure 3:
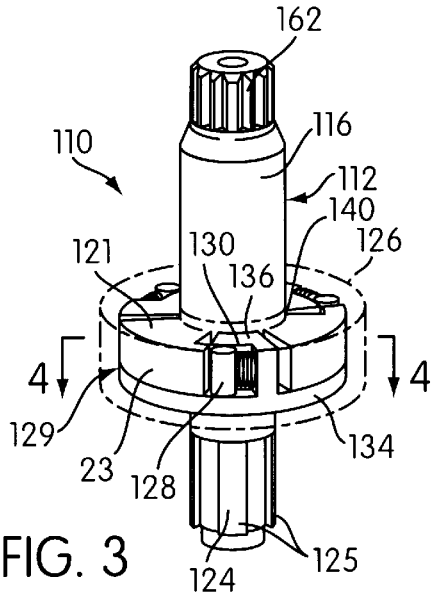
FIG. 3 is a perspective view of a passenger side crank assembly embodying the principles of the present invention, with a housing portion thereof shown in phantom lines.

As illustrated in FIG. 3, the drive assembly 20 includes a crank or clutch assembly, generally indicated at 110, which embodies the principles of the present invention. The crank or clutch assembly 110 generally comprises a drive member 112 operatively coupled with a driven member 114.

The drive member 112 constitutes a drivable input structure which receives an external driving force so as to be rotated about an axis. The drive member 112 can be driven, for example, by manual rotation of the handle member 40 illustrated in FIG. 2. The driven output structure 114 constitutes a driven output structure which is driven by said drive member 112 for rotational movement therewith about a common axis with the drive member 112.

As shown, the drive member 112 has a generally cylindrical rod portion 116 and the driven output structure 114 has a shaft portion 124. A disk shaped housing 126 (schematically shown in phantom lines in FIG. 3) has a generally cylindrical interior surface 127 and defines a cylindrical or disk shaped chamber which is disposed in surrounding relation about a generally disk shaped coupling assembly, generally indicated at 129, which couples the drive member 112 with the driven output structure 114 as will be described in greater detail later. The housing 126 is constructed and arranged to be rigidly fixed with respect to the motor vehicle door inner panel, and the rod portion 116 and the shaft portion 124 extend from opposite ends of the housing. The rod portion 116 extends through the inner door skin for engagement with the window crank handle 40.

The drive member 112 has a generally cylindrical rod portion 116 and a plurality of actuating members 118 integrally formed therewith. The rod portion 116 has a free end defining a plurality of grooves 162, which defines a male connector configured to engage a female portion of a manually rotatable window handle. The actuating members 118 project radially outward from the rod portion 116 from an end of the rod portion 116 opposite the free end and are circumferentially spaced from one another.

Each actuating member 118 has a generally wedge or sector shaped main portion 120 and a protruding portion 160. The wedge shaped main portion 120 has planar opposite surfaces 121 generally parallel to one another and extending from axially spaced positions on the rod portion 116 to positions adjacent the interior surface 127 of housing 126. The plane on which surfaces 121 lie are generally perpendicular to the axis of the rod portion 116. The narrower portion of the wedge configuration of main portion 120 is integrally formed with the rod portion 116, and the main portion 120 becomes progressively wider as it extends radially outwardly. Each actuating member 118, including the wedge portion, terminates in an arcuate, radially outermost surface 123 disposed adjacent to and generally parallel with the interior cylindrical surface 127 of housing 126. The protruding portion protrudes outwardly in a circumferential direction from the thickest portion of the wedge shaped main portion 120 and provides a portion of the radially outermost arcuate surface 123 parallel with cylindrical surface 127 of housing 126. The actuating members 118 have planar side surfaces 154 and 156 which are generally perpendicular to the aforementioned planar surfaces 121 and are divergent from one another as they extend away from the rod portion 118 to provide the aforementioned wedge shaped configuration of main portion 120. The planar side surface 154 extends the entire distance from the rod portion 118 to meet the radially outermost arcuate surface 123 of the main portion and form a comer therebetween. In other words, radially outermost edge of the surface 154 is coincident with the edge of the radially outermost, circumferentially extending arcuate surface 123 of the main portion 120. The opposite planar surface 156 is shorter that the surface 154, as it extends from the rod portion 116 until in meets with the projecting portion 160 of the main portion 120. The protruding portion 160 of each actuating member 118 is provided with a leading engagement surface 168.

The driven output structure 114 includes a shaft portion 124. The shaft portion 124 has a plurality of rib members 125 constructed and arranged to rigidly engage a pulley or drum assembly for a window cable to raise and lower a vehicle window in a manner well known in the art. The shaft portion 124 further includes a circular disk portion 134 formed integrally therewith at an end of the shaft portion 124 opposite the rib members and adjacent to the driving member 112. The circular disk portion 134 has a generally flat circular surface interrupted at circumferentially spaced locations by a plurality of integrally formed fork members 136 projecting outwardly therefrom. The flat surface portions 138 disposed between the fork member 136 slidably engage respective adjacent flat surfaces 121 of a respective adjacent main portion 120 of the driving member 112.

Each fork member 136 is generally of a sector configuration and has a radially inner arcuate surface 137. These surfaces 137 cooperate to slidably engage the side cylindrical surface of the rod portion 116 of driving member 112 at circumferentially spaced locations between the actuating members 118. Each fork member has a relatively large thickness portion 139 extending radially outwardly from the inner arcuate surface 137 thereof to a radially outermost arcuate surface 147 thereof positioned adjacent to and parallel with the interior surface 127 of housing 126. Each fork member 136 also has a relatively smaller thickness portion 141 extending from the inner arcuate surface 137 thereof to a radially outermost arcuate ramp surface 149 thereof positioned more radially inwardly from the radially outermost surface 147 of the thicker portion 139 and from the interior surface 127 of housing 126. At the interface between the thicker portion 139 and thinner portion 141 is a radially extending planar wall portion 143, which extends between the arcuate surface 147 and the arcuate ramp surface 149 and is generally perpendicular to each of such surfaces. The circumferential extent of fork member 136 is defined between side walls 150 and 152 on fork member 136 as shown. Side wall 150 extends radially outwardly from the inner arcuate surface 137 to the radial outer surface 147 of the fork member 136. Side wall 152, on the other hand, is shorter and extends from the inner arcuate surface 137 to the radially outermost arcuate ramp surface 149.

Although the radially outermost ramp surfaces 149 of the smaller thickness portions 141 may appear in the Figures to be somewhat parallel with the cylindrical interior surface 127 of housing 126, it is important to note that these surfaces actually gradually approach the cylindrical surface 127 as they extend away from the wall portion 143 so as to provide what is known as a ramp surface configuration.

When the drive member 112 and driven output structure 114 are coupled, the rod portion 116 and the shaft portion 124 are axially aligned. Actuating members 118 are each disposed between a pair of fork members 136, and each fork member 136 is disposed between a pair of actuating members 118. The actuating members 118 slide freely across the surface of the circular disk portion 134. The interengaged portions of the rod portion 116 and shaft portion 124 are held rotatably within the housing 126. The housing 126 is provided with a top aperture 140 through which the rod portion 116 extends and a bottom aperture (not shown in the figures) through which the shaft portion 124 extends.

As discussed above, the disk shaped housing 126 (schematically shown in phantom lines in FIG. 3) defines a cylindrical or disk shaped chamber and is disposed in surrounding relation about the disk portion 134, fork members 136 and actuating member 118 as shown. The interior cylindrical surface 127 of housing 126 combines with a respective arcuate ramp surface 149, radially extending wall 143, and leading surface 168 of the actuating members 118 to define a plurality of circumferentially spaced chambers 169 as shown.

The drive assembly 20 includes a plurality of roller members 128 and spring members 130. Each of the chambers 169 houses an associated roller member 128 and associated spring member 130. The roller members 128 are preferably cylindrical in form, although they can also be spherical. The spring member 130 is a coil spring, but may also be a leaf spring or an elastic, resilient block material, such as rubber. The roller members 128 each have a cross sectional diameter that is slightly smaller than the distance between the ramp surface 149 and cylindrical surface 127 of housing 126 as measured at a location adjacent the radially extending wall 143 of the associated fork member (e.g., the radial length of wall 143 is greater than the diameter of roller members 128), and slightly larger than the distance between the ramp surface 149 and the cylindrical surface of housing 126 as measured toward the opposite end of ramp surface 149. This is due to the fact that ramp surface 149 becomes closer to or converges toward the cylindrical surface 127 of the housing 126 as it extends away from wall 143.

The spring members 130 are disposed between the roller members 128 and the wall 143 and function to bias the roller members 128 away from the wall 143 toward the narrower portion of chamber 169. The roller member 128 is prevented from leaving the chamber 169 because the distance from the ramp surface 149 of the fork member 136 to the inner surface 127 of the housing 126 becomes less than the diameter of the roller member 128 at a certain point, at which the roller members 128 are shown in FIG. 4.

Figure 4:
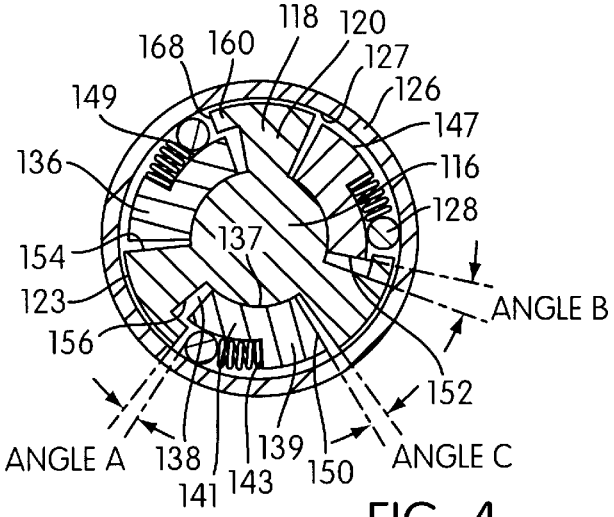
FIG. 4 is an enlarged cross sectional view of the passenger side crank assembly in a pre-loaded condition taken along the line 4—4 in FIG. 3.

In FIG. 4, the roller members 128 are shown at stop point 153 in a pre-loaded condition. At this point the roller members 128 cannot be advanced any farther toward engagement surface 168 of the actuating member 118. As can be seen in the cross-sectional view in FIG. 4, the spring members 130 pre-load or bias the roller members into wedged engagement between the cylindrical interior surface 127 of the housing 126 and the ramp surface 149 of the fork member 136.

The slope of a line tangent to the ramp surface 149 at the roller stop point 153 is significant because the ramp surface 149 of the fork member 136 forms part of a locking mechanism that prevents the shaft portion 124 from being backdriven as will be explained in detail hereinbelow. The method of locking the fork members 136 against backdrive requires, as would be recognized by those skilled in the art, that the effective coefficient of friction between the roller members 128 be greater than the tangent of the ramp angle. If the coefficient of friction is taken to be 0.16 (assuming, for example, that the locking components of the device use lubricated steel on steel), then the maximum ramp angle formed by the ramp surface 149 is given by this equation:

$$\tan^{-1}(0.16)=9^\circ$$

This means that the slope of the tangent at the roller stop point 153 should be less than nine degrees. In the preferred embodiment, shown in FIGS. 3 through 6, an effective ramp angle of 5° is used.

The choice of materials used to fabricate the housing 126, the ramp surface 149 and the roller members 128 is also significant because the locking mechanism relies on frictional forces between the roller member 128 and the ramp surface 149 and between the roller member 128 and the inner cylindrical surface 127. The preferred materials for the assembly include zinc die casting for the rod portion 16 and actuating members 118, sintered powdered metal (for example MP1F-FL 4605 which is an alloy steel) for the shaft portion 124, and low carbon steel for the housing 26. The pre-loaded spring members 130 can be leaf springs, coil springs or rubber blocks.

The stiffness of the pre-loaded spring members 130 is preferably very low. The purpose of the spring members 130 is to pre-load the roller members 128 into initial engagement with the ramp surfaces 148 on the fork members 136 and the inner surface 127 of the housing 126. The stiffness of all the pre-loaded spring members 130 combined should not exceed the system resistances measured out at the cable drum 30 or pulley because a high value of the spring tension will not allow disengagement of the roller members 128 when override motion is required.

Angle A in FIG. 4 indicates the angular distance or number of degrees the leading surface 168 of each actuating member 118 must to rotate before it contacts a respective roller member 128 when the roller member 128 is in the pre-loaded, at rest position. Angle B indicates the angular distance separating the surface 156 of the actuating member 118 and the shorter side surface 152 of the fork member 136. Angle C is the angular distance separating the longer surface 150 of the fork member 136 and the longer side 154 of the actuating member 118.

The one way crank or clutch assembly 110 shown in FIG. 3 is configured to be used on the passenger side of a vehicle to raise and lower a vehicle window. The shaft portion 124 and the housing 126 of the assembly 120 are typically disposed within a inner door panel and typically only a portion of the rod portion 116 extends through the door and into the passenger compartment of the vehicle for connection with the window crank handle.

Operation of the Crank Assembly

In accordance with the objects of the present invention, the window regulator assembly, the guide rail 18 is constructed and arranged to guide the window panel 12 during movement of the window panel 12 between opened (lowered) and closed (raised) positions. The slider member 17 is constructed and arranged to be movable along the guide rail 18 between a first position wherein the window panel assumes the closed position and a second position wherein the window panel 12 assumes the open position.

The slider moving assembly 21 is constructed and arranged to move the slider member between the first and second position. The coupling assembly 23 of the slider moving assembly 21 is constructed and arranged to couple an output movement of the drive assembly 20 to the slider member 17. The drive assembly 20 includes the drivable input structure 112 and a driven output structure 114, which structures 112,114 are rotatable about a common axis. The coupling assembly 23 is connected with the output structure 114 to receive the output of the output structure 114, thereby enabling the coupling assembly 23 to couple the output movement of the drive assembly 20 to the slider member 17. The drivable input structure 112 is constructed and arranged to receive an external driving force so as to be rotated about its axis. The driven output structure 114 is driven for rotational movement about its axis by rotation of the input structure 112. The drive assembly 20 rollers 128 and spring members 130 are disposed within a housing 126 and constructed and arranged to prevent movement of the output structure 114 upon predetermined external force being applied thereto via the coupling assembly 23. The output structure ramp surfaces 149 each converge toward the housing 126. Each of the ramp surfaces 149 frictionally engages an associated one of the rollers 128, the rollers 128 being biased by the spring members 130 in a converging surface direction towards the converging surfaces between the ramp surfaces 149 and the housing 126. The rollers 128 are thus biased into wedging relation between the ramp surfaces 149 and the housing 126. Friction between the ramp surfaces 149 and the associated rollers 128 during application of the predetermined external force to the output structure urges rolling movement of the rollers 128 in the converging surface direction and into further wedging relation between the ramp surfaces 149 and the housing 126. The wedging relation of the rollers 128 between the ramp surfaces 149 and the housing 126 prevents movement of the output structure 114 upon application of the predetermined external force being applied thereto. The input structure 112 is rotatable to engage the rollers 128 upon application of the external driving force and thereby move the rollers 128 against the bias of the spring members 130 and away from the converging surface direction, the rollers 128 thus being moved out of the wedging relation between the ramp surfaces 149 and the housing 126 so that continued driven movement of the input structure 112 after engagement thereof with the rollers 128 is received by the output structure 114 so that the output structure 114 is thereby driven to move the slider member 17 and thus the window panel 12 via the coupling assembly 23.

FIG. 4 shows the relative positions of the actuating members 118, the fork members 136, the roller members 128 and the spring members 130 when the crank assembly 110 is at rest (in the pre-loaded position). When an operator rotates handle crank rigidly fixed with the grooves 162 of drive member 112 on the car door to lower the glass to open the window, the drive member is rotated in a counterclockwise direction as viewed in FIG. 4. Manual rotation of the drive member 112 causes the actuating members 118 to be positively driven in the counterclockwise direction so that angle A becomes zero and the engagement surfaces 168 of protruding portions 160 engage the roller members 128 and move them down the ramp surface 149 against the bias of springs 130. As a result, the roller members 128 are moved or dislodged out of their locking positions between ramp surface 149 and cylindrical housing surface 127 (see FIG. 5). The actuating member 118 continues to rotate until angle B is zero, at which time the surface 156 of each actuating member 118 engages the surface 152 of an adjacent fork member 136. Continued movement of the actuating members 118 in the counterclockwise direction causes movement of the fork members and hence the entire driven output structure 114 in the counterclockwise direction. This, in turn causes the pulley (not shown) connected to the shaft portion 124 to rotate in the counterclockwise direction to lower the window.

Figure 5:
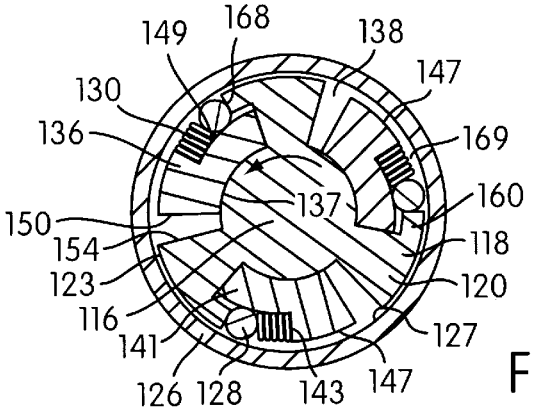
FIG. 5 is an enlarged cross sectional view of the passenger side crank assembly taken along the line 4—4 when the drive member is rotated in a counterclockwise direction to effect downward movement of the passenger side vehicle window.

FIG. 5 shows the relative positions of the fork members 136, the actuating members 118, the roller members 128 and spring members 130 when the window is being lowered using a crank handle. Therefore, it should be appreciated that angle A in FIG. 4 is less than angle B, so that the roller members can be moved out of their locking position before the actuating members 118 start to rotate the fork members 136. As soon as the driving input through the protruding portions 160 of the actuating members 118 ceases, the pre-loaded spring members 130 are once again free to move the roller members 128 into their locking positions between the ramp surface 149 and cylindrical surface 127 of housing 126. Once again the locking members take-up all free play of the window in the backdrive direction.

Figure 6:
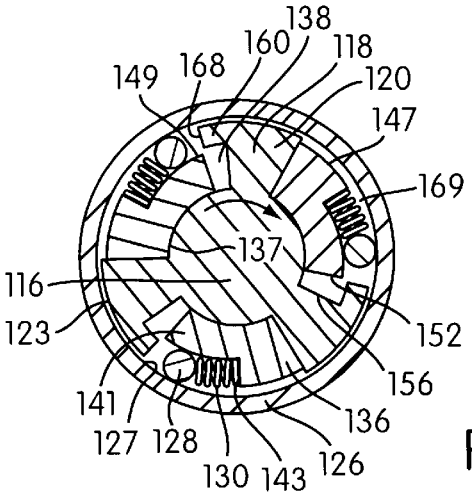
FIG. 6 is an enlarged cross sectional view of the passenger side crank assembly taken along the line 4—4 when the drive member is rotated in a clockwise direction to effect upward movement of the passenger side vehicle window.

When a vehicle passenger uses the handle on the car door to close the window, the drive member, and hence each actuating member 118, rotates in the clockwise direction as seen in FIG. 6. Angle C is greater than zero in the at rest position (before clockwise rotation begins) for tolerance purposes, although no minimum angle C is required. After the surfaces 154 of actuating members 118 contact the adjacent surfaces 150 of the adjacent fork member 136, continued rotation of the drive member 112 in the clockwise direction causes the actuating members 118 to move the fork members 136 in the clockwise direction. The direction of rotation favors the roller member 128 moving or rolling down the ramp 149 against the low spring tension of spring members 130, so that the roller members 128 are moved out of their pre-loaded or locking position. Thus, the fork members 136 and hence driven output structure 114 are free to be rotated in the clockwise direction freely. This causes the shaft portion 124 and pulley connected thereto to rotate in the clockwise direction to raise the vehicle window.

When the arrangement is at rest as shown in FIG. 4, if someone tries to open a closed or partially closed window by forcing the window itself downwardly, the applied force will attempt to rotate the cable pulley or drum, and hence the shaft portion 124 and fork members 136 operatively connected therewith, in the counterclockwise direction. This forced action on the window will cause the roller members 128 to attempt to roll further up the ramp surface 149 of the fork member, which will not occur due to the immediate locking action of rollers 128 between the ramp surface 149 and cylindrical housing surface 127. Thus, relatively very little play in the window is possible.

In the arrangement shown, if someone tries to lift the window directly to close it, the fork members 136 may be permitted to rotate clockwise. Because some rotation of the fork members 136 in this direction may be possible without the involvement of the actuating members 118, the window will not be locked by operation of the locking crank assembly against movement towards the closed direction, although some other accommodation (not shown) may accomplish locking against movement in the close direction.

Any backdriven force imparted directly to the window panel does not result in any substantial movement of the window as a result of substantially immediate wedging action of the rollers. In addition, the wedging of the rollers preferably prevents movement of the output structure 114 into engagement with the drivable input structure 112 so that no visible movement of the crank handle 40 occurs.

The present invention contemplates that the crank assembly itself can be adapted to lock the passenger side window against movement in the close direction by using a two way locking crank assembly (not shown). The two way locking crank (not shown) would employ separate fork members 136, actuating members 118, spring members 130 and rollers 128 arranged in the opposite or mirror image relation to that shown in the figures. Each fork member would cooperate with the housing to define two oppositely arranged chambers 169, and the actuating members 118 must be capable of bidirectional disengagement of roller members. This will prevent pulley or drum driven rotation in the clockwise direction in combination with the arrangement disclosed above for preventing drum driven rotation in the counterclockwise direction. A further advantage of such a crank assembly is that the same assembly can be used for both the drivers side and the passenger side windows. This will make assembly more complex but will have the advantage of creating a "non-handed" assembly.

Figure 7:
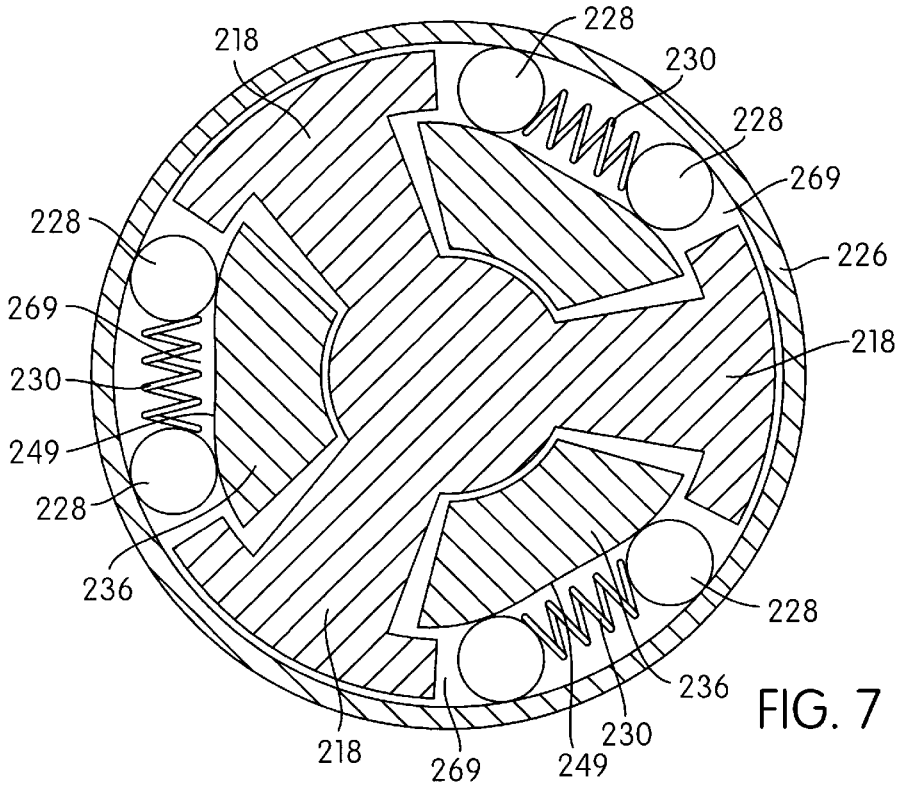
FIG. 7 is a cross sectional view of a bi-directional crank assembly in accordance with a second embodiment of the present invention.

In another two-way locking crank assembly, illustrated in FIG. 7, fork members 236, actuating members 218, spring members 230 and rollers 228 are similarly arranged in an opposite or mirror image relation to that shown in FIGS. 3–6. Each fork member cooperates with the pair of adjacent actuating members and the housing 226 to define circumferentially spaced chambers 269. Each chamber 269 contains a spring member 230 and a pair of rollers 228 on opposite sides of the spring member 230. The fork members 236 each have a double ramp surface 249, which diverges away from the housing as the ramp surface 249 extends circumferentially toward a central portion thereof, and which converges towards the housing as the ramp surface 249 extend away from the central portion thereof. Each spring member 230 biases the two rollers 228 on opposite sides thereof into wedging relation between the housing and the associated converging surface portions of the ramp surface 249. The actuating members 218 are capable of bi-directional disengagement of the adjacent rollers 228. More specifically, the rollers 228 adjacent to the actuating members in the driving direction which the actuating member is rotated are those rollers which are engaged by the actuating members 218 and moved toward the center of ramp surfaces 249 and out of wedging relation between the ramp surface 249 and the housing 226. The opposite rollers 249 which are not engaged by the actuating members 218 simply roll by force of friction out of wedged relation and toward the center of ramp surface 249.

For a backdrive force of 680 N applied to a cable, and a 30 mm drum on a cable/drum window regulator, this will translate to a backdrive torque of 10.2 Nm.

The circumferential force at the center of the roller members 128 (acting at radius R from the center of the assembly) is given by the equation:

$$F=10.2/R$$

The radial force due to wedging action of the ramp surface angle x is given by:

$$R=F/\tan x$$

The radial force acting as an internal pressure on a thin-walled cylinder of internal surface area A, internal radius r, wall thickness t and roller length y, the circumferential stress is estimated as:

$$S=Fr/At \tan x=F/(2(\pi)(y)(t)(\tan x))$$

If we let R=11.5, t=1.5, x=5 degrees, r=13.02 and y=8, then:

$$S=(10.2/0.115)/(2(\pi)(8)(1.5)(0.0875))=134 \text{ MPa}$$

As backdrive load is gradually increased, some surface deformation can be expected which will gradually increase the area of contact and reduce the rate of increase of pressure until equilibrium is achieved.

It should be understood that although the figures show interengagement between the drive member 112 and driven output structure 114 by using three fork members 136, three actuating members 118, three roller members 128, and three spring members 130, it is within the scope of this invention to use more or fewer of each of these members.

For a two way locking crank assembly, for each rotational direction, preferably two fork members, two actuating members, two roller members, and two spring members are provided at circumferentially spaced intervals, for a total of four such locking assemblies. Two locking assemblies are thus used to lock the window from being moved by direct engagement in both directions.

Figure 8:
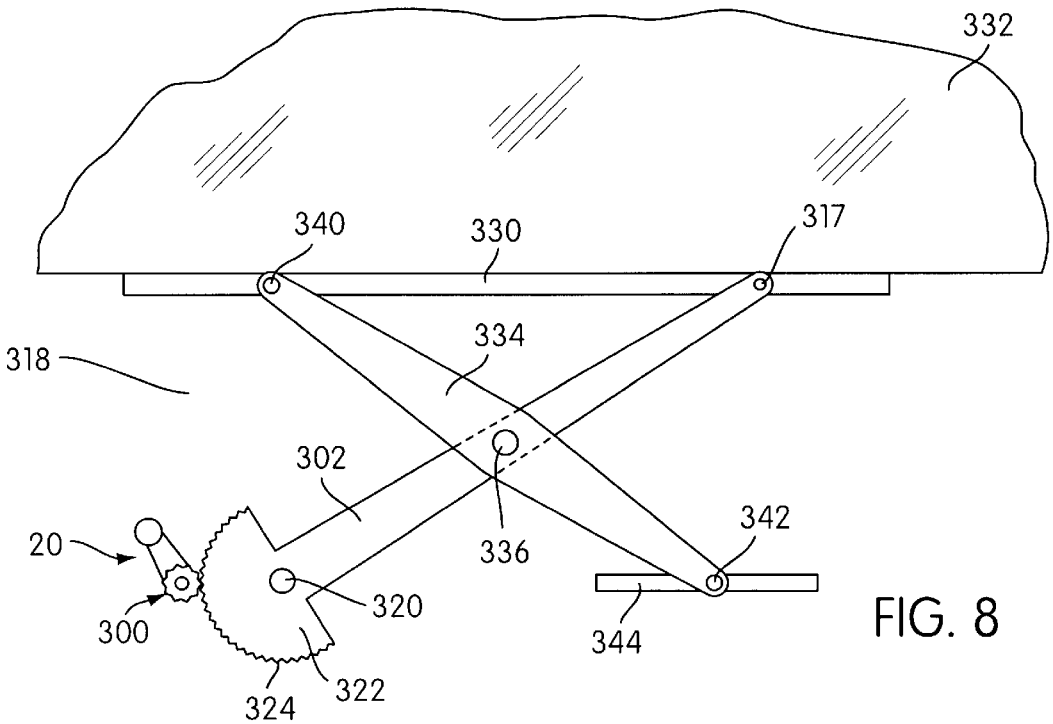
FIG. 8 is a perspective view of a cross-arm type window regulator assembly incorporating the crank assembly of the present invention, and shown incorporated in an automotive vehicle door structure.

As a further alternative embodiment, and as illustrated in FIG. 8, the window regulator may be of the cross-arm type. In this case, the coupling structure for coupling the drive assembly 20 to the slider member 317 comprises a pinion gear 300 fixed to the driven output shaft 124 of the driven output structure 114 and a main arm 302. The slider member is pivotally mounted to one end of the main arm 302, which in turn is pivotally mounted on the vehicle door 318 at pivot point 320. The opposite end of main arm 320 has a sector gear portion 322 comprising gear teeth 324 meshing with the gear teeth of the pinion gear 300. The slider member 317 is received within a track or guide rail 330 fixed in horizontal fashion along the bottom edge of a window panel 332.

A stabilizing arm 334 has a central portion thereof pivotally connected to a central portion of the main arm 302 at pivot point 336. A second slider member 340 is pivotally mounted on one end of stabilizing arm 334 and is received in the track or guide rail 330 in laterally spaced relation from the first slider member 317. A third slider member 342 is pivotally mounted to the stabilizing arm 334 at an end thereof opposite that which mounts the second slider member 340. The slider member 342 is received for sliding movement within a track 344 fixed to the door 318 and disposed in parallel relation to the track 330.

Upon manual rotation of the crank handle 40, the pinion gear 300 is driven by the driven output structure 114. The meshing of gear teeth 324 with the pinion gear 300 causes pivotal movement of the main arm 302 about the pivot point 320 in a direction determined by the direction that the crank handle is forced. When the pinion gear 300 is driven in a clockwise direction in FIG. 8, the main arm 302 will be pivoted in a counterclockwise direction about pivot point 320. This will drive the slider member 317 to the left in FIG. 8 and result in raising of the window panel 332. During this movement, the pivot point 336 is moved upwardly and the distance between tracks 330 and 342 is increased. The stabilizing arm is, as a result, moved into a more vertical disposition, and the slider member 340 moves to the right and the slider member 344 moves to the left in FIG. 8.

It will be appreciated that when the pinion gear 300 is driven in a counterclockwise direction, the reverse movement are accomplished to effect lowering of the window panel 332.

While the invention has been described in connection with what is presently considered to be the most preferred embodiments, it is understood that the invention is not limited to the disclosed embodiments but, on the contrary, is intended to cover various modifications and equivalent arrangements included within the spirit and scope of the appended claims.

What is claimed is:

1. A window regulator assembly comprising:

a window panel;

a guide track constructed and arranged to guide said window panel during movement of said window panel between opened and closed positions;

a slider member constructed and arranged to be movable along said guide track between a first position wherein said window panel assumes said closed position and a second position wherein said window panel assumes said open position;

a slider moving assembly constructed and arranged to move said slider member between said first and second positions, said slider moving assembly including a drive assembly and a coupling assembly constructed and arranged to couple an output movement of said drive assembly to said slider member;

said drive assembly including a drivable input structure and a driven output structure, said input and output structures being rotatable about a common axis, said coupling assembly being connected with said output structure to receive an output of said output structure and thereby enable said coupling assembly to couple an output movement of the drive assembly to the slider member, said drivable input structure constructed and arranged to receive an external driving force so as to be rotated about said axis, said driven output structure being driven for rotational movement about said axis by rotation of said input structure, said drive assembly including roller and spring members disposed within a housing and constructed and arranged to prevent movement of said output structure upon predetermined external force being applied thereto via said coupling assembly, said output structure having ramp surfaces each converging toward said housing, each of said ramp surfaces frictionally engaging as associated one of said rollers, said rollers being biased by said spring members in a converging surface direction, which is a direction towards a convergence between said ramp surfaces and said housing, said rollers thus being biased into wedging relation between said ramp surfaces and said housing wherein friction between said ramp surfaces and said associated rollers during application of said predetermined external force to said output structure urges rolling movement of said rollers in said converging surface direction and into further wedging relation between said ramp surfaces and said housing, wedging relation of said rollers between said ramp surfaces and said housing preventing movement of said output structure upon application of said predetermined external force being applied thereto, said input structure being rotatable to engage said rollers upon application of said external driving force and thereby move said rollers against the bias of said spring members and against said converging surface direction, said rollers thus being moved out of said wedging relation between said ramp surfaces and said housing so that continued driven movement of said input structure after engagement thereof with said rollers is received by said output structure so that said output structure is thereby driven to move said slider member and thus said window panel via said coupling assembly;

wherein said drivable input structure comprises a plurality of circumferentially spaced actuating members having associated protruding portions, said protruding portions having respecting leading surfaces constructed and arranged to engage and move said rollers a predetermined distance along said ramp surfaces against the converging surface direction to move said rollers out of wedging relation between said ramp surfaces and said housing, said protruding portions moving along said ramp surfaces against the bias of said spring members until other portions of said actuating members engage said driven output structure directly to apply a rotational force thereto and thereby rotatably drive said driven output structure in a rotational direction defined by the direction in which said rollers are moved out of said wedging relation so as to enable movement of said window panel in a downward direction.

2. A window regulator assembly according to claim 1, wherein said predetermined external force applied to said output structure comprises manual force applied to said window panel towards said opened position, said manual force applied to said window panel being coupled to said output structure by said coupling structure, and wherein movement of said window panel upon application of said manual force is prevented by said wedging relation of said rollers between said ramp surfaces and said housing.

3. A window regulator assembly according to claim 1, wherein said coupling assembly comprises a drum fixed for rotation with said driven output structure and a cable assembly connected between said drum and said slider member, said drum constructed and arranged drive to said cable assembly and thereby drive said slider member between said first and second positions upon driven movement of said driven output structure.

4. A window regulator assembly according to claim 3, comprising a mounting plate fixed to said window panel and mounting said window panel on said slider.

5. A window regulator assembly according to claim 1, wherein said coupling assembly comprises a pinion gear member fixed for rotation with said driven output structure and a pair of arm members, a first of said arm members having an end thereof mounting said slider member and an opposite end thereof having gear teeth meshing with said pinion gear, a second of said arm members having stabilizing slider members mounted on opposite ends thereof, one of said stabilizing slider members being received for sliding movement in said guide track, a second of said stabilizing slider members being received in a stabilizing track parallel with said guide track.

6. A window regulator assembly according to claim 1, wherein said actuating members extend radially outwardly from a drivable shaft portion of said drivable input structure, and wherein said other portions of said actuating members are disposed radially inwardly of said protruding portions.

7. A window regulator assembly according to claim 6, wherein said driven output structure comprises generally L-shaped, circumferentially spaced fork members.

8. A window regulator assembly according to claim 1, wherein a first plurality of said ramp surfaces converge toward said housing in one circumferential direction, and wherein a second plurality of said ramp surfaces converge toward said housing in an opposite circumferential direction, and wherein said predetermined external force applied to said output structure comprises a manual force applied to said window panel either towards said opened position or towards said closed position, said manual force applied to said window panel being coupled to said output structure by said coupling structure, wherein movement of said window panel upon application of said manual force towards said opened position is prevented by said wedging relation of a first plurality of said rollers between said first plurality of said ramp surfaces and said housing to prevent rotation of said output structure in said opposite circumferential direction, and wherein movement of said window panel upon application of said manual force towards said closed position is prevented by said wedging relation of a second plurality of said rollers between said second plurality of said ramp surfaces and said housing to prevent rotation of said output structure in said one circumferential direction.

* * * * *